US005671494A

United States Patent [19]

Civanelli et al.

[11] Patent Number: 5,671,494

[45] Date of Patent: Sep. 30, 1997

[54] METHOD AND ARRANGEMENT FOR ACHIEVING LOAD BALANCE IN WASHING MACHINES

[75] Inventors: Claudio Civanelli, Ispra; Rocco Galli, Travedona, both of Italy

[73] Assignee: Whirlpool Europe B.V., Veldhoven, Netherlands

[21] Appl. No.: 575,570

[22] Filed: Dec. 20, 1995

[30] Foreign Application Priority Data

Dec. 21, 1994 [IT] Italy ..... MI94A2600

[51] Int. Cl.[6] ..... D06F 33/02

[52] U.S. Cl. ..... 8/159; 68/12.06; 68/23.1

[58] Field of Search ..... 8/159; 68/12.06, 68/12.14, 23.1

[56] References Cited

U.S. PATENT DOCUMENTS

| | | | |
|---|---|---|---|
| 3,640,098 | 2/1972 | Eastall | 68/12.06 |
| 4,344,198 | 8/1982 | Arendt et al. | 8/159 X |
| 4,765,161 | 8/1988 | Williamson | 68/12.06 |
| 4,843,671 | 7/1989 | Hirooka et al. | 68/12.14 X |

FOREIGN PATENT DOCUMENTS

| | | | |
|---|---|---|---|
| 0071 308 | 2/1983 | European Pat. Off. | D06F 37/30 |
| 394 177 A3 | 10/1990 | European Pat. Off. | D06F 37/20 |
| 2425494 | 12/1979 | France | D06F 43/20 |
| 40 38 178 A1 | 6/1992 | Germany . | |
| 86197 | 4/1991 | Japan | 68/12.06 |
| 289998 | 12/1991 | Japan | 68/23.1 |
| 314496 | 11/1992 | Japan | 68/12.06 |

*Primary Examiner*—Philip R. Coe

*Attorney, Agent, or Firm*—Mark A. Davis; Thomas A. Schwyn; Robert O. Rice

[57] ABSTRACT

A method for achieving load balance in washing machines provided with a rotary drum driven by an electric motor under the control of control means, and in which a circuit is provided for measuring a physical quantity associated with information relative to the state (balanced or unbalanced) of the load in the drum, the method comprising, after the wash stage, a stage in which the drum speed is gradually increased during which the physical quantity is continuously monitored to ascertain the state of load distribution within the drum, and a stage of rapid rotational speed increase at the moment in which a state of balanced load distribution within the drum is detected.

11 Claims, 2 Drawing Sheets

METHOD AND ARRANGEMENT FOR ACHIEVING LOAD BALANCE IN WASHING MACHINES

BACKGROUND OF THE INVENTION

1. Field of the Invention

This invention relates to a method and arrangement for achieving load balance in washing machines provided with a drum operated by a variable speed electric motor, tachometer means for measuring the rotational speed of the motor and hence of the drum, or amperometer means for measuring the motor absorbed current or the motor control current, and electronic control means for controlling the motor speed so that between the end of the wash stage plus water discharge and the load spinning stage there is introduced a pre-spinning stage in which the motor accelerates to a speed less than the spinning speed.

2. Description of the Related Art

It is well known that if at the end of a wash cycle plus wash liquid discharge in an automatic washing machine the speed is increased to the spinning speed, the suspended machine masses, ie those relative to the clothes contained in the drum, the motor and the relative linkages connecting the drum to the motor, can undergo knocking and vibration which can compromise not only machine stability but also its operational integrity. The reason for such knocking and vibration lies in the fact that after discharging the free wash liquid (ie that not absorbed by the clothes), the clothes collect in the lowest part of the drum. Consequently when the drum speed increases, the clothes firstly "roll" randomly until they reach a critical speed (known as the orbital speed) at which the centrifugal force acting on the clothes equals the force of gravity and makes the clothes remain adhering to the inner surface of the drum in a substantially fixed position. However in many cases the clothes are not uniformly distributed within the drum at this orbital speed, with the result that further increase in speed with the load of clothes unbalanced can produce that vibration and knocking which are prejudicial to both machine stability and operational integrity, and cause the considerable noise generated by the washing machine when in this operating condition.

To remedy these drawbacks, certain methods and arrangements have been proposed involving measurement of the fluctuations in the current absorbed by the motor or of the variation in the motor speed (by a tachometer connected to the motor). If the range of this current fluctuation or voltage variation is large, this signifies that the load in the drum is unbalanced. The known or commonly used methods and/or arrangements for remedying this or for preventing this state of unbalance arising at the spinning stage involve a gradual increase in drum speed from the wash speed to the orbital speed, then checking the balance only when the orbital speed is attained, this speed then being maintained unaltered for a certain time, after which the state of the load is checked.

If after this certain time at the orbital speed it is ascertained that the load has attained a reasonably uniform distribution, the rotational speed is rapidly increased to the spinning speed. If however this check shows that at the orbital speed there is an intolerable load unbalance, the speed is reduced to the wash speed (with consequent separation of the clothes from the drum wall), after which it is again gradually increased to the orbital speed with the intention of achieving a different and more uniform distribution for the load. If this attempt also fails, it is followed by others. After a certain number of failed attempts the spinning speed is suitably reduced so as to reduce the effects of the unbalanced load. Such an arrangement is described for example in European patent 0071308.

In all cases the described action is taken after the load has been distributed, ie when the load is already at its orbital speed. This known arrangement comprising repetition of attempts involving remaining at the orbital speed results in a lengthening of the operating time of the washing machine, and in some cases represents an incomplete solution to the problems connected with drum instability.

SUMMARY OF THE INVENTION

The objects of the present invention are therefore to provide a method and arrangement which reduce the duration of the washing machine operating cycle while simultaneously statistically increasing the percentage of balanced loads obtainable during spinning, with consequent reduction in vibration and knocking and increased machine stability, and also the possibility of lightening the machine mechanical structure leading to cost reduction, while using components (tachometer, electronic control modules and microprocessors) already present in current washing machines, resulting in further reduction in the additional costs of its implementation and obtaining a reduction in those cases in which the washing machine generates further noise associated with load unbalance.

These and further objects which will be more apparent from the detailed description given hereinafter are attained by a method and arrangement, the inventive aspects of which are defined in the accompanying claims.

The inventive concept is such that after the final wash stage plus discharge of free wash liquid and before the complete orbital speed of the load is reached, a stage follows in which the washing machine is made to gradually increase the rotational speed of its drum, during which a physical quantity (for example the motor rotational speed, its absorbed current or the current controlling the static switch connected in series with the motor) is continuously monitored. This physical quantity is one which is indicative of the state of balance or unbalance of the drum, so that the initial moment in which the load is balanced in an acceptable form can be determined, to be followed by sudden increase in the motor speed up to for example spinning speed. In this respect it has been found that it is not in fact necessary to await the attaining of orbital speed (with the aforesaid drawbacks) before checking load distribution, it being sufficient to monitor it continuously beforehand, ie at lower speeds in that, as has been found in a statistically relevant number of cases, during this pre-spinning stage cases have been found with significant frequency in which at a given moment conditions exist in which the load although not being completely orbital is uniformly distributed within the drum and consequently balanced, such a load condition however not necessarily existing subsequently. Hence as stated, with the present invention, at the moment in which such a load balance state exists the speed is instantaneously increased with high acceleration to the spinning speed, whereas with the known method it can happen that such an instantaneous condition of balance no longer exists when the check is actually made, ie at the final orbital speed of the load. Consequently with the invention the moment of uniform load distribution during a stage prior to the attaining of complete orbital speed by the load is detected, and practically in that moment the speed is raised to spinning speed, so fixing the favourable and hence balanced load distribution. It has been found during statistically significant tests that using such a procedure a higher uniform load distribution percentage is achieved than in the aforedescribed known method.

BRIEF DESCRIPTION OF THE DRAWINGS

The invention will be more apparent from the detailed description of a preferred embodiment thereof given hereinafter by way of non-limiting example with reference to the accompanying drawings, in which.

DESCRIPTION OF THE PREFERRED EMBODIMENT

Figure 1:
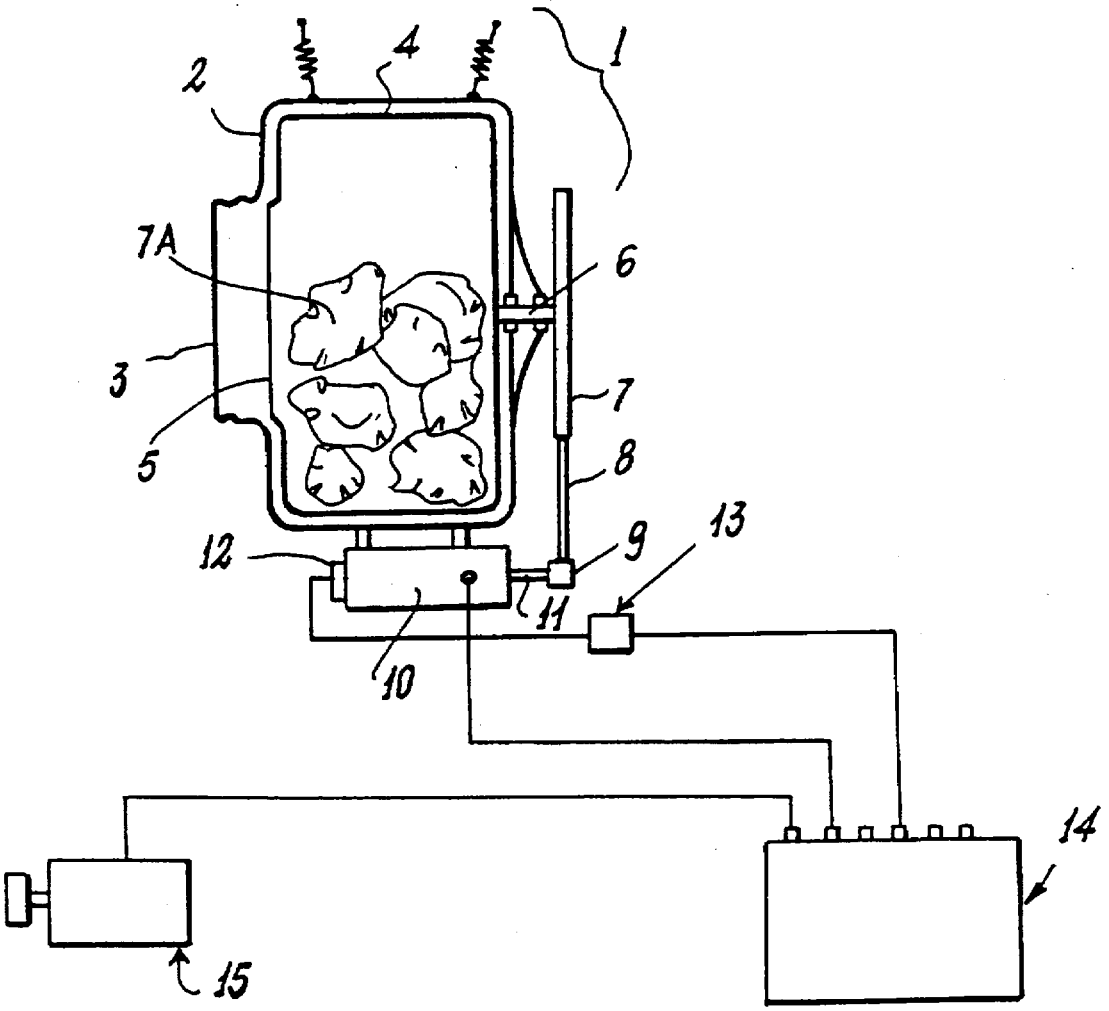
FIG. 1 is a schematic section through an automatic washing machine and the relative control means.

In FIG. 1 the reference numeral 1 indicates overall a washing machine of known structure. Of this, FIG. 1 shows only those parts required or may be required for a clear understanding of the invention, and which comprise: an outer tub 2 with a clothes loading and unloading aperture 3; a drum 4 with access mouth 5, mounted rotatable within the tub 2 and carrying the load; a shaft 6 rotatably supported by the tub 2 and torsionally rigid at one end with the drum 4; a first pulley 7 keyed onto the other end of said shaft; a transmission belt 8 cooperating with the first pulley 7; an electric motor 10 rigid with the tub 2; a second pulley 9 keyed onto the motor shaft 11 and cooperating with the transmission belt 8; a tachometer 12 operationally connected to the shaft 11 of the motor 10 to measure its speed; an electronic control module 14 controlling the motor with regard both to the absorbed current and hence power and to the relative r.p.m.; an interface 13 for converting the analog speed signal of the tachometer 12 into a digital signal accessible to the digital part of the control module; and an electronic timer 15 controlling all functions of the washing machine 1 and hence the wash, the distribution of the load 7A over the inner cylindrical wall of the drum 4, and the spinning.

As an alternative to or in combination with the use of the tachometer 12 and the relative interface 13, an amperometric sensor with relative interface can be used to measure the current absorbed by the motor or to measure the control current of a static switch connected in series with the motor.

In this configuration in both the aforesaid cases the electronic module 14 powers the motor 10 under the control of the timer 15 such that the operating conditions scheduled for each stage of the wash cycle are respected in relation to the particular state of the timer, as is well known to the expert of the art. For example, if during the wash cycle there is a stage in which the motor has to operate at a given speed and at predetermined time intervals, the timer 15 transmits the corresponding information to the electronic module 14, which via the feedback loop formed by the module and, for example, the tachometer 12 causes the motor to operate in a corresponding manner, independently of factors which tend to modify the predetermined conditions.

Figure 3:
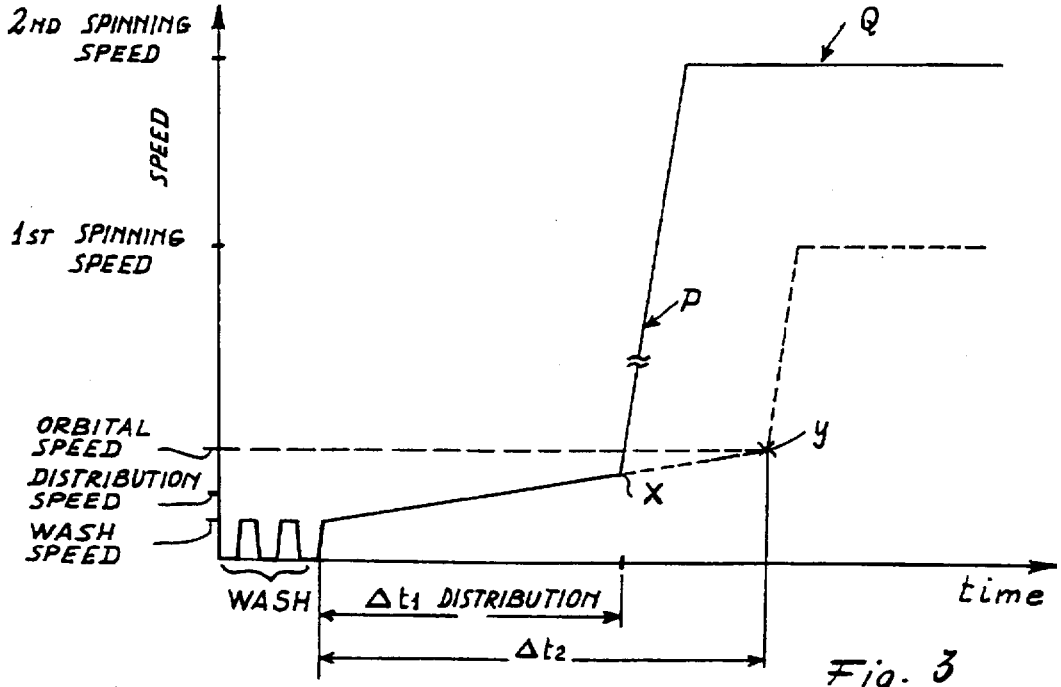
FIG. 3 is a time/speed diagram which further illustrates the invention.

When the electronic module 14 has received the command from the timer 15 to implement the pre-spinning of the clothes contained in the drum 4, ie after the wash and the discharge of the free wash liquid, it firstly controls the r.p.m. and power of the motor 10 such that the motor r.p.m. increases gradually (see FIG. 3), for example from 55 r.p.m. to 120 r.p.m. within 10–30 seconds. During this acceleration the electronic module 14 receives signals from the tachometer 12 or amperometric sensor which indicate any fluctuations in the current dr in the motor r.p.m. consequent on load unbalance, these being continuously monitored, for example by conventional comparator circuits and logic gates. At a certain rotational speed, for example on reaching 80–90 r.p.m., ie a speed less than the orbital speed which in the present example is 120 r.p.m. (point Y of FIG. 3), the signal relative to the speed sensor or current sensor reaching the electronic module indicates that these fluctuations have been substantially reduced to an acceptable predetermined level (point X of FIG. 3) and that at that moment the load is distributed in a substantially balanced manner over the wall of the drum 4. A possible explanation of this phenomenon is that at this speed (for example 80–90 r.p.m.) the load has only partially orbited in that this speed is insufficiently high to overcome the force of gravity to which the clothes in the central part of the drum are subjected and which are only dragged by the rotation of the drum itself. These clothes dragged into rotation are however subjected to a centrifugal force which at certain moments (for example because by rolling, those clothes not in orbit become positioned in a region of the drum to which a smaller quantity of clothes adheres, hence in a region in which having a greater possibility of radial movement they are subjected to a greater centrifugal force) can overall determine the balanced load condition. On sensing this state of equilibrium the electronic module 14 passes this information to the timer 15 which, conversely, causes the electronic module 14 to feed maximum power to the motor 10, which undergoes the highest acceleration (sections P and Q of FIG. 3) provided for spinning, so orbiting the load. If balanced load distribution does not occur before the point of complete load orbiting, the spinning speed can be reduced in known manner. Alternatively one or more repetitions of the described attempt can be made, after which if balancing has still not been achieved the spinning speed is finally reduced.

It should be again noted that conventional arrangements do not take account of the fact that balanced distribution may be achieved just occasionally or only for brief periods (at the point X in the example of FIG. 3), before reaching the complete load orbiting speed (indicated by Y in FIG. 3), but instead check the state of the load only when orbiting is total, by checking for a certain period of time during this condition whether the load is balanced or not, then if the load is unbalanced repeating, possibly a number of times, the procedure involving moderate or low acceleration starting from the wash speed and rechecking the balance condition at the complete load orbiting speed, indicated by way of example as 120 r.p.m. (point Y).

According to the invention, at the end of the wash operations the timer 15 feeds to the electronic control module 14 a signal by which this latter causes the motor 10 to start rotating the drum at gradually increasing speed (pre-spinning).

Figure 2:
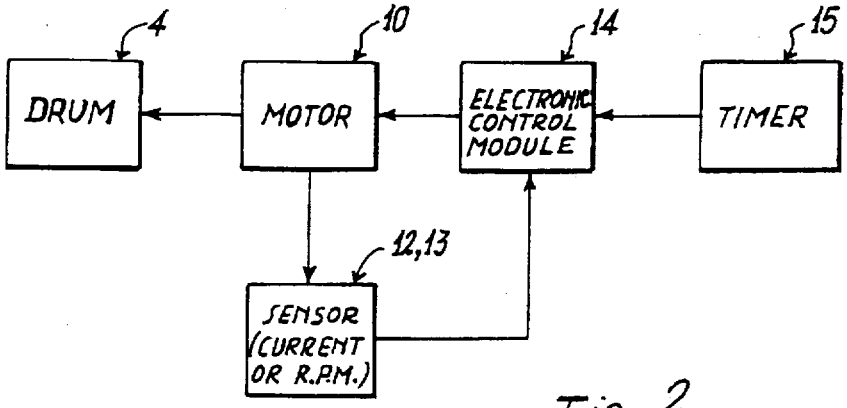
FIG. 2 is a block diagram of the control means.

The information which the electronic module 14 continuously receives via the feedback loop (FIG. 2) into which the sensor (12 and tachometer interface 13) is connected can represent either a balanced condition or an unbalanced condition for the load of clothes contained in the drum. The electronic module 14 continuously checks, by comparison with predetermined values present in the memory, whether this information corresponds to a balanced or an unbalanced load condition. If at a certain moment (for example at the point X of FIG. 2, after a time $\Delta t_1$) the information corresponds to a balanced load, the electronic module 14 causes the motor 10 to suddenly increase its speed (as shown by the section P of FIG. 3), so that the load 7A stabilizes in the balanced state and the spinning stage commences. If instead the information continues to show a load-unbalanced condition in relation to the reference values compared by the electronic module 14, this latter feeds a command to the motor 10 to continue to increase its speed only gradually, and consequently that of the drum containing the load.

If no load balance has been achieved up to the moment of complete load orbiting (point Y of FIG. 3), at which the entire load is immobilized against the peripheral wall of the drum, the motor 10 is set to a reduced spinning speed. Alternatively, the load distribution stage could be repeated by firstly reducing the speed (along the section from Y to I in FIG. 3 where I is the commencement point of the acceleration stage which follows the wash stage) and then repeating the already described balancing and monitoring procedure.

We claim:

1. A method for achieving load balance in washing machines provided with a rotary drum driven by an electric motor under the control of control means, and in which a circuit is provided for measuring a physical quantity associated with information relative to the state, balanced or unbalanced, of the load in the drum, the method comprising: gradually increasing the drum speed from a wash speed toward an orbital speed during a stage in which the physical quantity is continuously monitored to ascertain the state of load distribution within the drum, and or accelerating the drum during a stage of maximum acceleration causing an instantaneous rotational speed increase up to a first high speed, to hereby orbit the load, at the moment in which a state of balanced load distribution with the drum is detected.

2. A method as claimed in claim 1, wherein the physical quantity monitored is the rotational speed of the drum.

3. A method as claimed in claim 1, wherein the physical quantity monitored is the current absorbed by the motor.

4. A method as claimed in claim 1, wherein the physical quantity monitored is the control current of a static switch in series with the motor.

5. A washing machine comprising a rotary dram driven by an electric motor under the control of control means, a circuit for measuring a physical quantity associated with information relative to the state, balanced or unbalanced, of the load in the dram wherein the washing machine includes, after a wash stage but before a high speed spinning stage, a stage in which the drum rotational speed is gradually increased from the wash speed toward an orbital speed during which the physical quantity is continuously monitored, and means for causing an instantaneous rotational speed increase up to a first high speed, to thereby orbit the load, when the measuring circuit senses that the load is in a balanced state within the drum.

6. An arrangement as claimed in claim 5, wherein the physical quantity is the motor current, the motor speed or the control current of a static switch in series with the motor, said currents being measurable by amperometric means, whereas the speed is measurable by a tachometer.

7. An arrangement as claimed in claim 5, wherein the physical quantity monitored is the rotational speed of the drum.

8. An arrangement as claimed in claim 5, wherein the physical quantity monitored is the current absorbed by the motor.

9. An arrangement as claimed in claim 5, wherein the physical quantity monitored is the control current of a static switch in series with the motor.

10. A method as claimed in claim 1, wherein on reaching orbital speed without a state of balanced load distribution within the drum being detected, the drum speed is increased to a second high speed that is less than the first high speed.

11. An arrangement as claimed in claim 5, wherein on reaching orbital speed without a state of balanced load distribution within the drum, the dram speed is increased to a second high speed that is less than the first high speed.

* * * * *